United States Patent [19]

Amico et al.

[11] Patent Number: 5,035,264

[45] Date of Patent: Jul. 30, 1991

[54] ADJUSTABLE STATOR RETAINER ASSEMBLY

[75] Inventors: Russell P. Amico, Castaic; George M. Klier, Granada Hills, both of Calif.

[73] Assignee: HR Textron Inc., Valencia, Calif.

[21] Appl. No.: 588,918

[22] Filed: Sep. 27, 1990

[51] Int. Cl.[5] ..... F15B 13/044

[52] U.S. Cl. ..... 137/625.65; 251/129.11

[58] Field of Search ..... 137/625.65; 281/129.11

[56] References Cited

U.S. PATENT DOCUMENTS 4,507,634 3/1985 Vanderlaan ..... 335/272

4,641,812 2/1987 Vanderlaan et al. ..... 251/129.11 X

*Primary Examiner*—Gerald A. Michalsky

*Attorney, Agent, or Firm*—Nilsson, Robbins, Dalgarn, Berliner, Carson & Wurst

[57] ABSTRACT

A direct drive servovalve having a stator and rotor mounted upon a housing within which a spool valve is reciprocally disposed for engagement with the rotor and movement thereby in response to the application of appropriate electrical signals. The stator assembly is adjustable and after appropriate adjustment there is provided a retainer means secured to the closed end of an isolation tube for clamping the stator assembly in place relative to the rotor assembly of the moored motor. The clamping assembly includes an annular member having a downwardly depending skirt which engages the stator. The annular member is held in place by a retainer ring threadably secured to the outer surface of the isolation tube or alternatively behind fasteners which are threadably received by the closed end of the isolation tube. A separate non load bearing housing cover is positioned over the motor.

14 Claims, 4 Drawing Sheets

FIG. 2
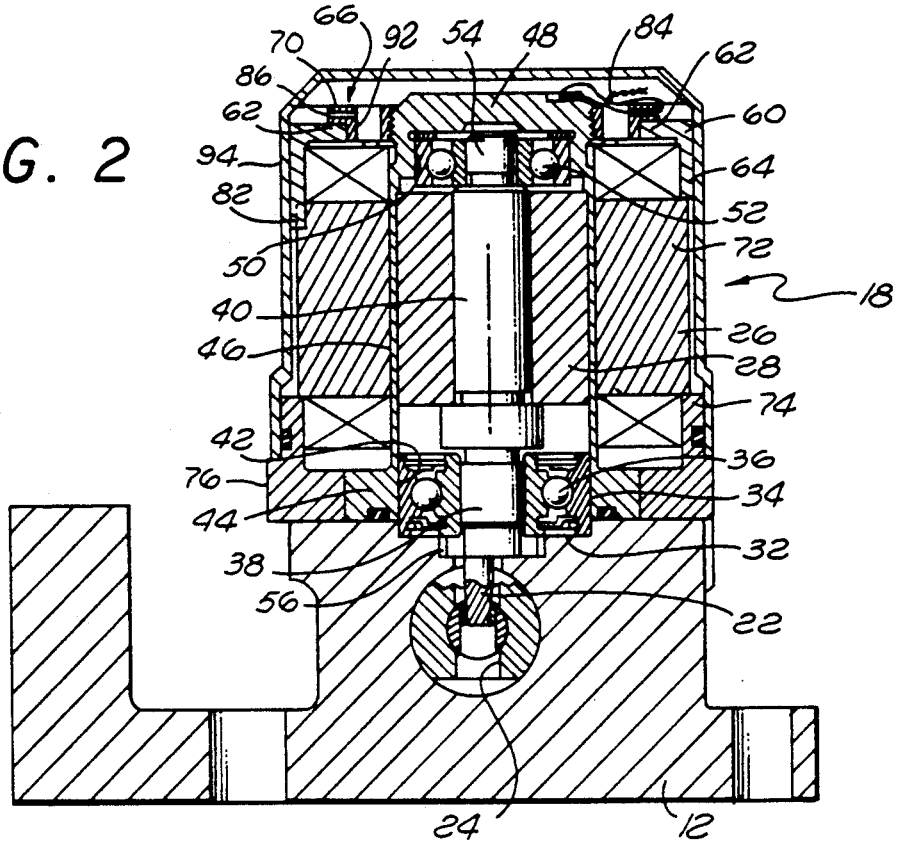
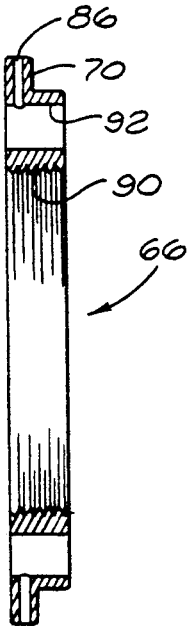
FIG. 4
FIG. 3
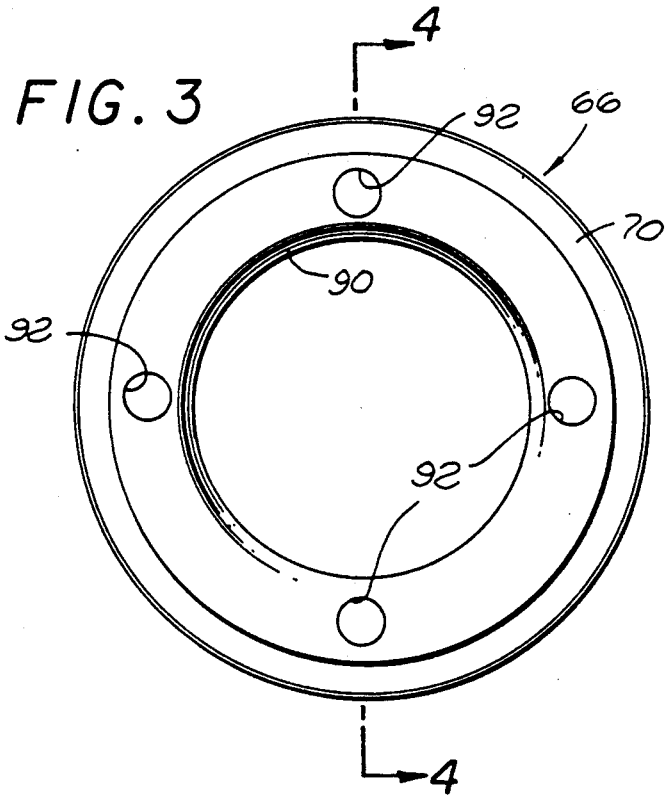

ADJUSTABLE STATOR RETAINER ASSEMBLY

FIELD OF THE INVENTION

This invention relates to direct drive servovalves and more particularly to a direct drive servovalve in which rotational motion of a motor rotor is converted into linear motion of a spool valve wherein the stator of the drive motor is adjustable and the motor includes a retainer assembly to secure the stator.

BACKGROUND OF THE INVENTION

Torque motor-driven spool valves are well known in the art including such valves which operate through the utilization of a rotary torque motor having a drive member extending from the rotor thereof into contact with the spool valve to directly reciprocate the spool valve within a bore provided in the valve housing to thereby control the flow of fluid from a source thereof to the load in response to electrical signals applied to the drive motor. Typical of such direct drive servovalves is that illustrated in U.S. Pat. No. 4,793,377 issued Dec. 27, 1988, to Larry E. Haynes et al. The invention described and claimed herein is an improvement over the direct drive servovalve disclosed in U.S. Pat. No. 4,793,377 and therefore the disclosure of U.S. Pat. No. 4,793,377 is incorporated herein by this reference.

The drive motors of such devices include a rotor and stator disposed within a housing in such a manner that the rotor assembly is subjected to the high pressure fluid typically used in servo control systems with which the device is associated. In such devices, it is desirable to have the ability to properly position the rotor to accomplish null centering of the rotor assembly and thereafter to position and clamp the stator relative thereto. Typical of prior art devices of the type described are U.S. Pat. Nos. 4,507,634 and 4,641,812. In each of these devices, the motor housing is utilized as a load carrying structure to clamp the stator in place subsequent to its proper positioning. Furthermore, to retain proper positioning between the stator and rotor assemblies, a locking pin and structural adhesive is utilized as is shown in U.S. Pat. No. 4,507,634. Alternatively, as is shown in U.S. Pat. No. 4,641,812, once the nulling process is completed and the motor stator assembly properly located by index pins, then the outer housing and the motor stator assembly are clamped in place by threading a nut onto a threaded extension of the rotor casing. In either structure, the motor housing becomes a load carrying member for clamping the stator assembly in place. Obviously, such a structure renders it extremely difficult to disassemble such valves for repair and/or maintenance and then reassemble them while maintaining the desired positioning of the stator and rotor assemblies.

It would be desirable in such structures to provide a retainer assembly for securing the stator of the drive motor while retaining the ability to position the stator within a 360° rotational envelope, to securely clamp and lock the stator in the desired rotational position and to eliminate the motor housing cover as the load carrying structure which locks and retains the stator assembly in place.

SUMMARY OF THE INVENTION

In accordance with the present invention, there is provided a direct drive servovalve which includes a valve spool reciprocally mounted within a bore in a valve housing along with motor means having a rotor and a stator and including a drive member to engage the valve for movement within the bore to provide control over the flow of fluid through the valve. A retainer means is disposed adjacent a closed end of an isolation tube within which the rotor is disposed. The retainer means is secured to the closed end of the isolation tube for clamping the stator assembly in place relative to the rotor assembly. A separate cover means is then disposed over the motor means.

BRIEF DESCRIPTION OF THE DRAWINGS

FIG. 2 is a cross-sectional view taken about the lines 2—2 of FIG. 1;

FIG. 3 is a bottom plan view of a retaining ring;

FIG. 4 is a cross-sectional view of the retaining ring of FIG. 3 taken about the lines 4—4 thereof;

DESCRIPTION OF THE ILLUSTRATIVE EMBODIMENT

Figure 1:
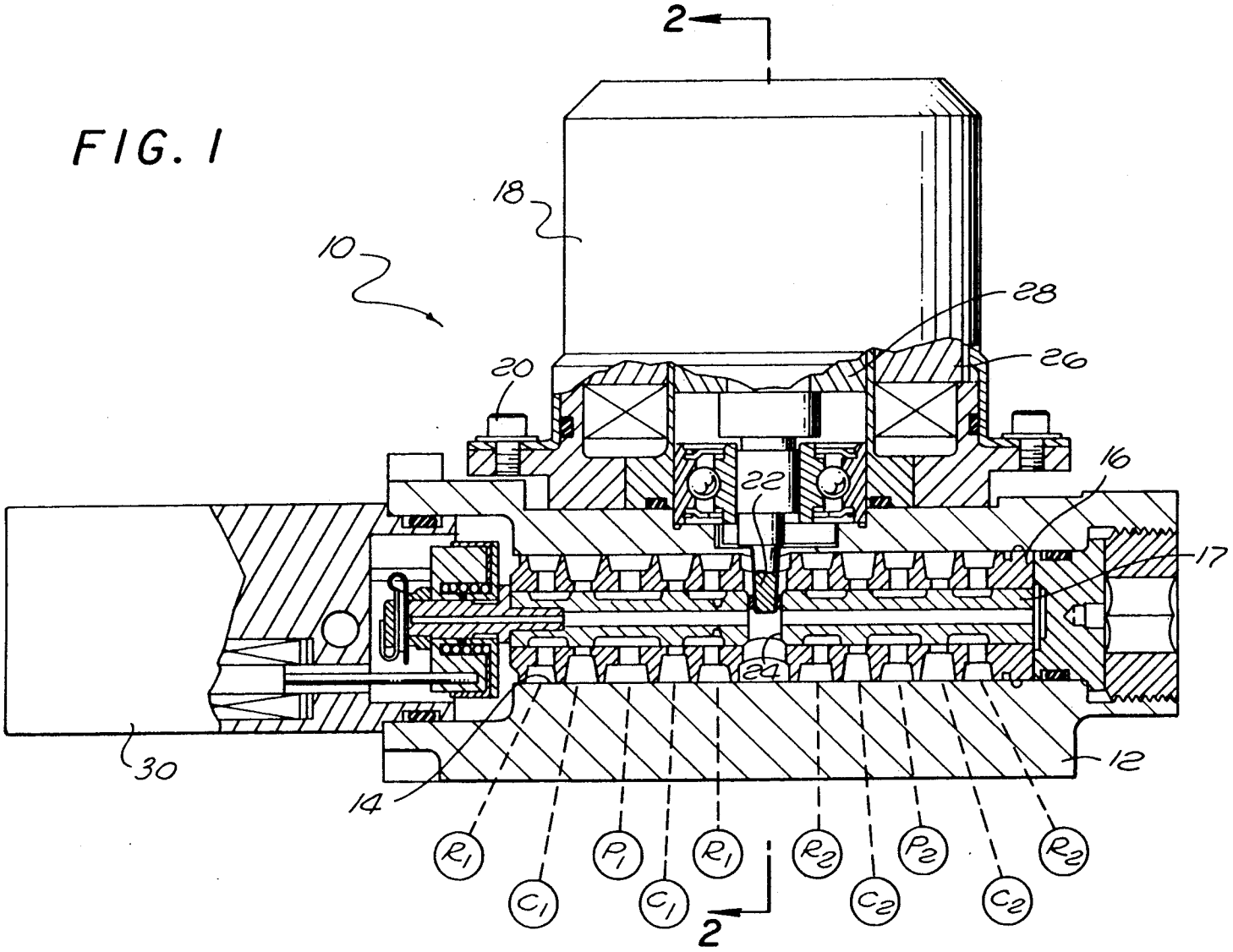
FIG. 1 is a longitudinal cross-sectional view of one embodiment of a direct drive servovalve constructed in accordance with the principles of the present invention.
Figure 5:
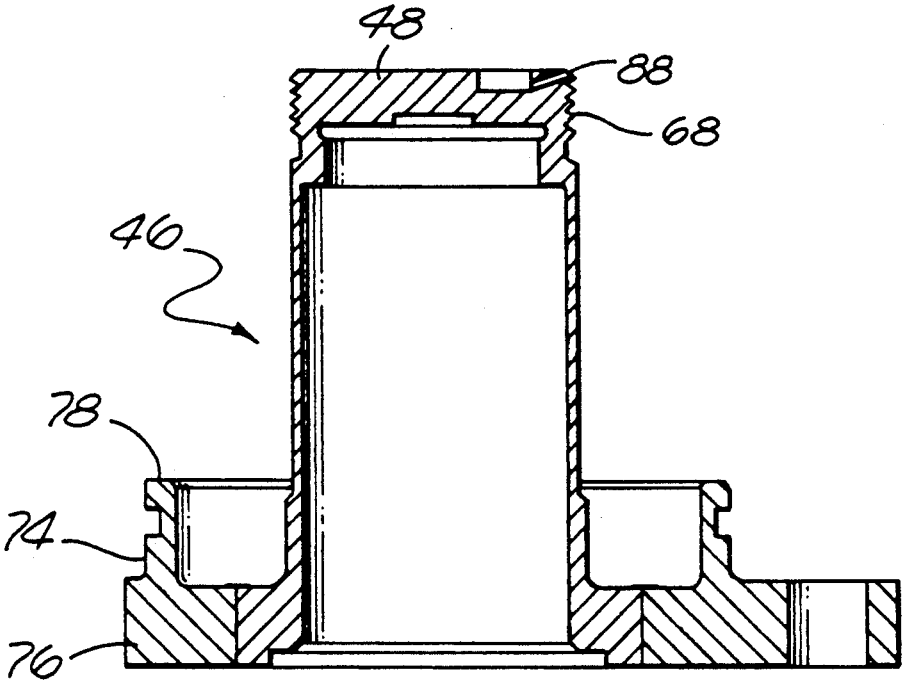
FIG. 5 is a cross-sectional view of an isolation tube as used in the direct drive servovalve illustrated in FIG. 1.
Figure 6:
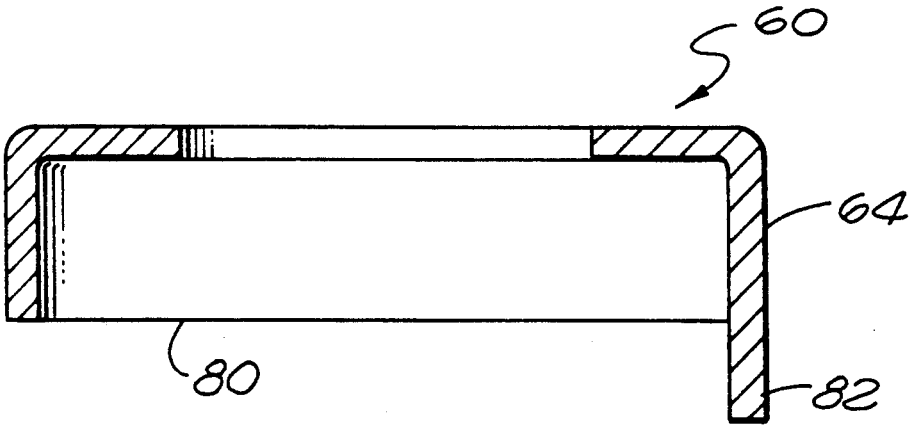
FIG. 6 is a cross-sectional view of the retainer.

By reference now to FIG. 1, there is shown a direct drive valve 10 constructed in accordance with the principles of the present invention. As is therein shown, a valve housing 12 includes a bore 14 within which there is positioned a sleeve 16. A reciprocally movable spool valve 17 is mounted within the sleeve 16. A servovalve torque motor 18 is affixed to the housing 12 by means of bolts or other fasteners 20 so that a drive member 22 engages an opening 24 provided therefor in the spool 17 to move the spool 17 in response to electrical signals applied to the motor means 18 as is well known in the art.

As is illustrated in FIGS. 1 and 2, the motor means is a rotary motor including a stator 26 and a rotor 28 as is well known in the art.

As is shown particularly in FIG. 1, the direct drive servovalve constructed in accordance with the principles of the present invention includes appropriate ports for the control of fluid from dual sources thereof under pressure P1 and P2 to, for example, a dual tandem actuator (not shown) and from the actuator to return through the utilization of dual cylinder ports. Such is indicated by the designations P1, R1 and C1 as well as P2, R2 and C2. The valve assembly 10 may also include an LVDT 30 as is well known in the prior art. The construction of the rotary direct drive servovalve as illustrated in FIGS. 1 and 2 and thus far described is well known in the prior art and additional detail with regard thereto is not believed to be necessary.

As is shown more particularly in FIG. 2, the valve housing 12 defines a first recess 32 which receives the outer surface 34 of a bearing means 36 mounted upon one end 38 of the rotor shaft 40 to the motor means 18. The recess 32 conforms to the outer surface 34 cross-sectional configuration of the bearing 36 and has a depth which is substantially less than the longitudinal length of the outer surface 34 of the bearing 36. As a result and as is clearly illustrated in FIGS. 1 and 2, when the bearing is received within the recess 32, a substantial portion of the outer surface 34 thereof protrudes from the housing 12.

As a result of the longitudinal dimension of the outer surface 34 of the bearing 36, it can be seen from FIGS. 1 and 2 that the bearing is mutually received within a second recess 42 defined by the lower portion 44 of the isolation tube 46. The isolation tube 46 surrounds the rotor 28 of the motor means 18 and isolates hydraulic fluid from the stator portion 26 of the motor means 18.

The isolation tube 46 also includes an upper closed end portion 48 thereof which defines a third recess 50 which receives a second bearing means 52. The bearing means 36 and 52 are utilized to support the rotor shaft 40 in a properly aligned position within the isolation tube 46. Such alignment is obtained by inserting the end 54 of the shaft 40 by way of an interference fit into the inner race of the bearing means 52. The outer race of the bearing means 52 is then inserted by means of a locational slip fit between the third recess 50 and the outer race of the bearing means 52. The bearing means 36 is then inserted by means of an interference fit between the outer surface 34 of the bearing means 36 and the second recess 42 inner surface as provided in the lower portion 44 of the isolation tube 46. A locational slip fit is provided between the lower portion 38 of the shaft 40 and the inner race of the bearing means 36. Subsequent to this assembly, which now provides essentially a solid structure between the isolation tube 46 and the rotor 28, the assembly is inserted into the first recess 32 by a locational slip fit between it and the outer surface 34 of the bearing means 36. It can, therefore, be seen by those skilled in the art that the outer surface 34 of the bearing means 36 is utilized as the surface with respect to which the motor assembly 18 and the housing 12 are aligned. By then appropriately aligning the sleeve 16 within the housing 12 and positioning the spool 17 therein, it can be seen that the longitudinal axis of the rotor shaft 40, the drive member 22, the opening 24 and the opening 56 through which the drive member extends are all axially aligned when viewed in FIG. 1 and when the spool 17 is in its null position.

By reference now more particularly to FIGS. 2 through 6, there is illustrated and will be described more in detail, one embodiment of a retainer assembly for a direct drive servovalve constructed in accordance with the principles of the present invention. As is illustrated, the stator 26 is secured in position by a retainer assembly which is secured to the closed upper end 48 of the isolation tube 46. In accordance with this specific embodiment, the retainer assembly is threadably secured to the outer upper surface of the isolation tube 46 in such a manner that a flange urges an annular member having a downwardly depending cylindrical skirt thereon into engagement with the stator for clamping the stator between the skirt and an upstanding wall provided as part of the motor assembly.

As is shown, the retainer 60 includes an annular member 62 having a downwardly depending skirt 64. A retainer ring 66 is threadably secured to the outer surface 68 of the upper closed end 48 of the isolation tube 46. As is shown, the retainer ring 66 includes an outwardly extending flange 70 which overlaps the annular member 62 in such a manner that as the ring 66 is threaded onto the surface 68, the flange applies downwardly exerted clamping pressure against the pole piece 72 of the stator 26. There is also provided an upstanding wall 74 which is part of the base 76 of the isolation tube 46. The wall 74 defines a shoulder 78 upon which the pole piece 72 rests.

The downwardly depending skirt 64 defines a peripheral edge 80 from which depends a key 82. The key 82 engages a key way provided in the pole piece 72 so that when the retaining member 60 is disposed in place, as illustrated in FIG. 2, rotation of the retaining member 60 also rotates the stator 26. Such rotation is utilized to accomplish appropriate null balance of the direct drive servovalve.

To accomplish the desired null balance of the direct drive servovalve as illustrated in FIGS. 1 and 2, the spool 17 is positioned so that it is at the hydraulic null where no fluid flow (other than leakage) is taking place between the source and drain for the valve. Thereafter, the stator 26 is rotated so that a magnetic peak is obtained insofar as positioning of the stator and rotor are concerned. After this adjustment, the retaining ring 66 is securely tightened thus applying the clamping force as above-described to secure the stator in place in its proper adjustment. As a security measure, a lock wire 84 is threaded through appropriate openings provided in the retaining ring 66 and the top 48 of the isolation tube 46 to preclude inadvertently loosening the retaining ring 66. To accommodate the locking wire, openings 86 are provided in the flange 70 of the locking ring 66 while openings 88 are provided in the upper closed end 48 of the isolation tube 46. In addition, to secure the locking ring, threads are formed on the inner surface 90 thereof which are threadably received by the threads formed on the outer surface 68 of the upper portion 48 of the isolation tube 46. Openings 92 are provided in the locking ring to receive an appropriate tool for properly torquing the locking ring in place so that the flange 70 clamps the stator 26 between the periphery 80 of the retainer 60 and the shoulder 78 of the wall 74.

After the drive motor has been thus assembled, it can function adequately at this time. However, to preclude contamination of the coils in the stator 26 and to otherwise protect the same, a housing 94 is secured in place by the fasteners 20 to environmentally protect the motor 18. As will be evident to those skilled in the art, the housing 94 does not function in any fashion to clamp or otherwise secure the stator or any other portion of the drive motor.

Figure 7:
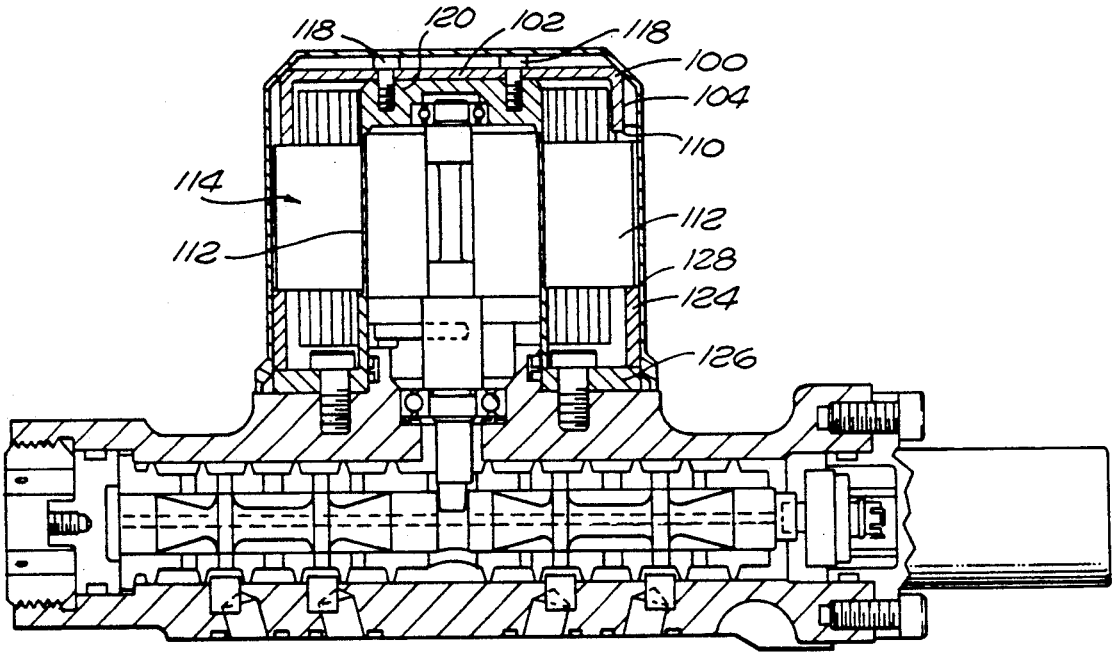
FIG. 7 is a cross-sectional view of an alternative embodiment of a direct drive servovalve constructed in accordance with the principals of the present invention.
Figure 8:
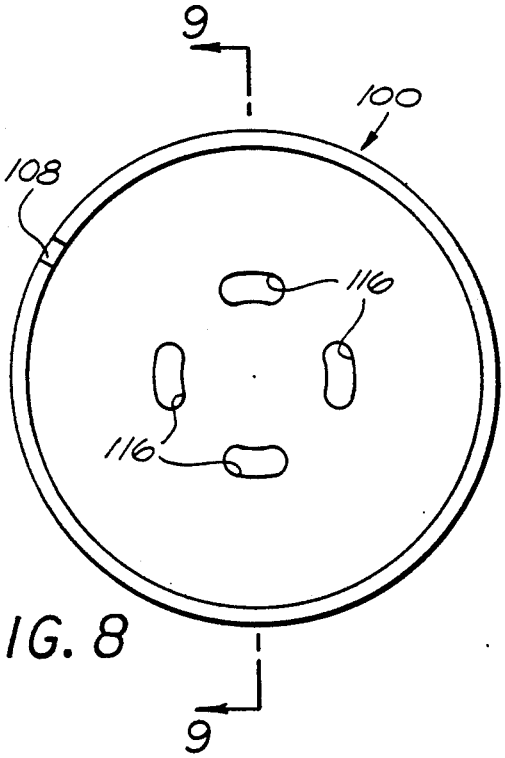
FIG. 8 is a bottom plan view of the retainer as used in the structure of FIG. 7.
Figure 9:
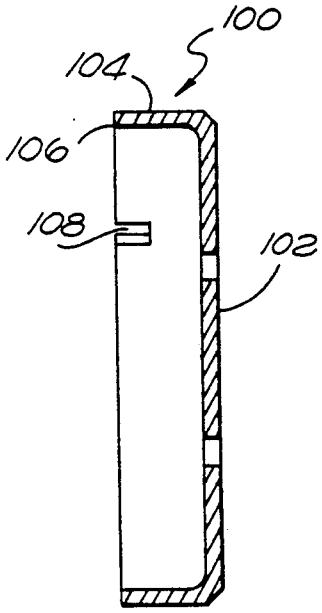
FIG. 9 is a cross-sectional view taken about the lines 9—9 of FIG. 8.

By referring now more particularly to FIGS. 7 through 9, there is illustrated an alternative embodiment of a retaining assembly for a motor of a direct drive servovalve constructed in accordance with the principles of the present invention. The structure of the valve as well as the stator and rotor of the drive motor is substantially the same as above-described and thus will not be described in detail at this point. As is shown in FIGS. 7 through 9, the retainer assembly includes an inverted cup shaped member which fits over the top of the isolation tube of the rotor and is secured in place by appropriate fasteners to thereby clamp the stator between the retainer and the shoulder of an upstanding wall forming part of the motor assembly.

As is shown in detail, the retainer 100 includes a plate member 102 having a downwardly depending skirt 104 which defines a periphery 106. A key way 108 is defined by the periphery 106 and receives a key 110 which is affixed to the pole piece 112 of the stator 114. The plate 102 defines a plurality of openings 116 therein. Fasteners of a standard threaded nature as shown at 118 are inserted through the openings 116 and into threaded bores in the closed upper end 120 of the isolation tube 122. The pole pieces 112 of the stator rest upon a motor support 124 which is retained upon the base 126 of the isolation tube 122 and defines a shoulder 128 upon which the pole piece 112 rests.

After assembly of the motor and valve as illustrated in FIG. 7, the retainer 100 is rotated to accomplish the appropriate null balance as above-described. Thereafter, the fasteners 118 are secured firmly in place to thus apply the clamping force to secure the pole pieces 112 of the stator between the shoulders 128 and periphery 106 of the support 124 and the skirt 104 respectively. Thereafter, for security purposes, the heads of the fasteners 118 are safety wired to prevent their becomming loosened during use. As is clearly illustrated in FIG. 8, the openings 116 are elongated to provide the ability to rotate the retainer 100 through a predetermined angular distance to accomplish the desired null balance.

There has thus been disclosed alternate embodiments of a direct drive servovalve having an adjustable stator with a retainer assembly therefor which retainer assembly clamps the stator of the drive motor in place without reliance upon a motor housing.

What is claimed is:

1. A direct drive servovalve comprising:

(1) a valve housing defining a bore therein;

(2) a valve spool reciprocally received within said bore for movement to control fluid flow therethrough from a supply port;

(3) motor means having a rotor and a stator and including a drive member for engagement with said valve spool at a predetermined point to move said valve spool in said bore;

(4) said rotor including an isolation tube having a closed end;

(5) said stator surrounding said isolation tube;

(6) retainer means disposed adjacent said closed end of said isolation tube and including first alignment means;

(7) said stator including second alignment means for cooperatively engaging said first alignment means for positioning said stator relative to said rotor;

(8) means securing said retainer means to said isolation tube adjacent said closed end thereof for clamping said stator in place; and (9) separate cover means disposed over said motor means.

2. A direct drive servovalve as defined in claim 1 wherein said retainer means includes a downwardly depending cylindrical skirt member engaging said stator for applying clamping force thereto when said retainer means is secured to said isolation tube.

3. A direct drive servovalve as defined in claim 2 wherein said cylindrical skirt member includes a periphery defining said first alignment means.

4. A direct drive servovalve as defined in claim 3 wherein said first alignment means is a key extending from said periphery.

5. A direct drive servovalve as defined in claim 3 wherein said first alignment means is a key way formed within said periphery.

6. A direct drive servovalve as defined in claim 2 wherein said retainer means further includes an annular member from which said skirt member depends and said securing means includes a flange extending outwardly from said isolation tube and overlapping said annular member.

7. A direct drive servovalve as defined in claim 6 wherein said securing means is threadably secured to said isolation tube.

8. A direct drive servovalve as defined in claim 7 wherein said securing means is a ring having a threaded interior surface and said isolation tube includes a threaded exterior surface adjacent said closed end for threadably receiving said ring.

9. A direct drive servovalve as defined in claim 2 wherein said retainer means further includes a plate member from which said skirt depends.

10. A direct drive servovalve as defined in claim 9 wherein said plate member defines a plurality of openings therethrough for receiving said securing means.

11. A direct drive servovalve as defined in claim 10 wherein said securing means includes a plurality of threaded fasteners received by said isolation tube closed end.

12. A direct drive servovalve as defined in claim 8 wherein said first alignment means is a key extending from said skirt member.

13. A direct drive servovalve as defined in claim 11 wherein said first alignment means is a key way defined by said skirt member.

14. A direct drive servovalve as defined in claim 2 which further includes a wall member defining a shoulder, said stator being clamped between said skirt member and said shoulder when said retainer means is secured to said isolation tube.

* * * * *